US005288211A

United States Patent [19]

Fry

[11] Patent Number: 5,288,211

[45] Date of Patent: Feb. 22, 1994

[54] INTERNAL BAFFLE SYSTEM FOR A MULTI-CYLINDER COMPRESSOR

[75] Inventor: Emanuel D. Fry, Tecumseh, Mich.

[73] Assignee: Tecumseh Products Company, Tecumseh, Mich.

[21] Appl. No.: 910,785

[22] Filed: Jul. 8, 1992

[51] Int. Cl.[5] ..... F04B 39/12

[52] U.S. Cl. ..... 417/312; 417/269; 181/403

[58] Field of Search ..... 417/312, 269, 273; 181/403, 264, 269

[56] References Cited

U.S. PATENT DOCUMENTS

| | | | |
|---|---|---|---|
| 3,876,339 | 4/1975 | Gannaway | 417/312 |
| 3,924,968 | 12/1975 | Gaines et al. | 417/273 |
| 4,273,519 | 6/1981 | Gannaway | 417/273 |
| 4,316,705 | 2/1982 | Siewert | 417/273 |
| 4,474,541 | 10/1984 | Siewert | 417/273 |
| 4,534,710 | 8/1985 | Miguchi et al. | 417/312 |
| 4,813,852 | 3/1989 | Ikeda | 417/312 |
| 4,838,769 | 6/1989 | Gannaway | 417/312 |
| 4,930,995 | 6/1990 | Suzuki | 417/312 |
| 4,988,269 | 1/1991 | Blass | 417/312 |

*Primary Examiner*—Richard A. Bertsch
*Assistant Examiner*—Peter Korytnyk
*Attorney, Agent, or Firm*—Baker & Daniels

[57] ABSTRACT

A compressor assembly is disclosed including a compressor mechanism mounted within a hermetically sealed housing. A cylinder block contains a plurality of reciprocating pistons within compression chambers. The compression chambers include a discharge valve which permits compressed refrigerant to empty into the common discharge chamber. A baffle system is included within the common discharge muffler chamber to eliminate pressure pulses and cross talk between discharge valve assemblies, thereby increasing the discharge valve opening speed and correspondingly increasing the compressor efficiency.

15 Claims, 3 Drawing Sheets

INTERNAL BAFFLE SYSTEM FOR A MULTI-CYLINDER COMPRESSOR

BACKGROUND OF THE INVENTION

The present invention relates generally to a hermetic compressor assembly and, more particularly, to such a compressor having a plurality of compression chambers wherein the compression chambers empty into a common discharge chamber.

Hermetic compressors comprise a hermetically sealed housing having a compressor mechanism mounted therein. The compressor mechanism may include a crankcase or a cylinder block defining a plurality of compression chambers in which gaseous refrigerant is compressed and subsequently discharged into a common discharge cavity.

A disadvantage to prior compressor designs is that the valve performance of the discharge valves is reduced because of discharge pressure pulses (sometimes called cross talk) within the common discharge muffler cavity. During operation, each compression chamber injects a pulsed stream of compressed refrigerant into the discharge cavity. This discharge pulse of compressed refrigerant creates a pressure pulse that travels through the discharge cavity and impacts the discharge valves of the other compression chambers.

The impact of a pressure pulse against a discharge valve inhibits the opening of the valve during that valve's discharge cycle. By slowing the opening of the discharge valve, more energy is consumed in opening the valve and compressing the refrigerant, thereby creating a less efficient compressor.

The action of the pressure pulse retaining the discharge valve in the closed position increases the power consumption and reduces valve efficiency of the compressor. The increased power consumption also raises the temperature of the discharge valve. An increase in valve temperature may decrease the life span and effectiveness of the discharge valve leaf.

Some prior art compressors have tried to reduce the pressure pulses affecting each of the compression chambers by creating a bulkhead wall between the plurality of discharge valves and the outlet port of the common discharge chamber. A prior art compressor, such as U.S. Pat. No. 4,813,852, discloses a bulkhead wall dividing a common discharge chamber into sections which empty into a common outlet port. Each section contains a discharge valve assembly connected to an associated compression chamber. The pressure pulses from each discharge valve are separated from each other by means of the bulkhead wall isolating each discharge from each other. In this way, no discharge pulses or cross talk may affect other discharge valve assemblies.

A disadvantage of totally separating the discharge ports from one another is that the pressure within each section is increased with a possibility of reflecting the pressure pulse back into its originating discharge valve. The separated sections also increase the average back pressure on the valve, reducing the speed of the valve, thereby reducing compressor efficiency. The totally separated sections also reduce the ability of refrigerant to flow to the common discharge chamber outlet port.

The present invention is directed to overcoming the aforementioned problems associated with multi-cylinder compressors, wherein it is desired attenuate and reduce pressure pulses within a common discharge chamber while minimally restricting the refrigerant flow.

SUMMARY OF THE INVENTION

The present invention overcomes the aforementioned problems associated with prior art compressors by providing an internal baffle system within the common discharge muffler chamber creating connected sub-chambers. These sub-chambers reduce the discharge pressure pulses affecting discharge valve operation. In restricting the passage of compressed refrigerant through the common discharge chamber by creating connecting sub-chambers, pressure pulses between discharge valves are reduced. By reducing the pressure pulses or cross talk between discharge valves, back pressure on the discharge valves may be reduced thereby increasing the efficiency of the discharge valves and therefore the efficiency of the compressor.

Generally, the invention provides a hermetic compressor including a plurality of compression chambers for discharging compressed fluid past discharge valves into a common discharge chamber. The common discharge chamber is separated by baffles or restricted passageways disposed within the discharge chamber The baffles separate the common discharge chamber into sub-chambers, each communicating with at least one discharge valve assembly. The sub-chambers defined by the baffles are connected together permitting compressed refrigerant to flow between the sub-chambers before exiting the common discharge chamber.

In one form of the invention, the baffles within the discharge chamber are created by integral web members that partially seal off the discharge valves from one another.

An advantage of the compressor of the present invention is that pressure pulses or cross talk between discharge valves are reduced thereby increasing the discharge valve opening speed and correspondingly increasing the compressor efficiency. The faster opening valves permit increased pumping rates and higher compressor efficiency.

Another advantage of the compressor of the present invention is that the baffles do not completely seal each discharge valve assembly from one another, thereby lowering the back pressure encountered by the discharge valves compared to the baffles completely separating each discharge valve assembly from one another.

The various features discussed above combine to result in a hermetic compressor which runs quietly with an increased efficiency.

The invention, in one form thereof, provides a hermetic compressor with a hermetically sealed housing containing a motor compressor unit. The compressor unit includes a cylinder block defining a plurality of cylinder bores each having a piston reciprocable therein. Each cylinder bore includes an associated discharge valve. The hermetic compressor includes a common muffler chamber within the housing in communication with the discharge valves into which the discharge valves empty. The common muffler chamber includes an exit port. A baffle arrangement separates the common muffler chamber into a plurality of sub-chambers, each sub-chamber in communication with a respective discharge valve. The baffle arrangement permits fluid communication between the sub-chambers and other locations other than at the exit port whereby pressure pulses between the discharge valves are reduced.

In one form of the invention, the baffle arrangement is formed by a plurality of web members on the cylinder block dividing the common muffler chamber into sub-chambers. The baffle arrangement forms a clearance passage within the common muffler chamber which is optimized for a given design. The size of the baffle is formed so that crosstalk is throttled but the pressure drop through the muffler system is minimized.

In another form of the invention, the top cover plate portion is attached to the cylinder block which with the cylinder block defines the common muffler chamber. Web portions divide the common muffler chamber into a plurality of sub-chambers connected by restricted passageways. These restricted passageways reduce discharge cross talk and back pressure spikes between discharge valve assemblies.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
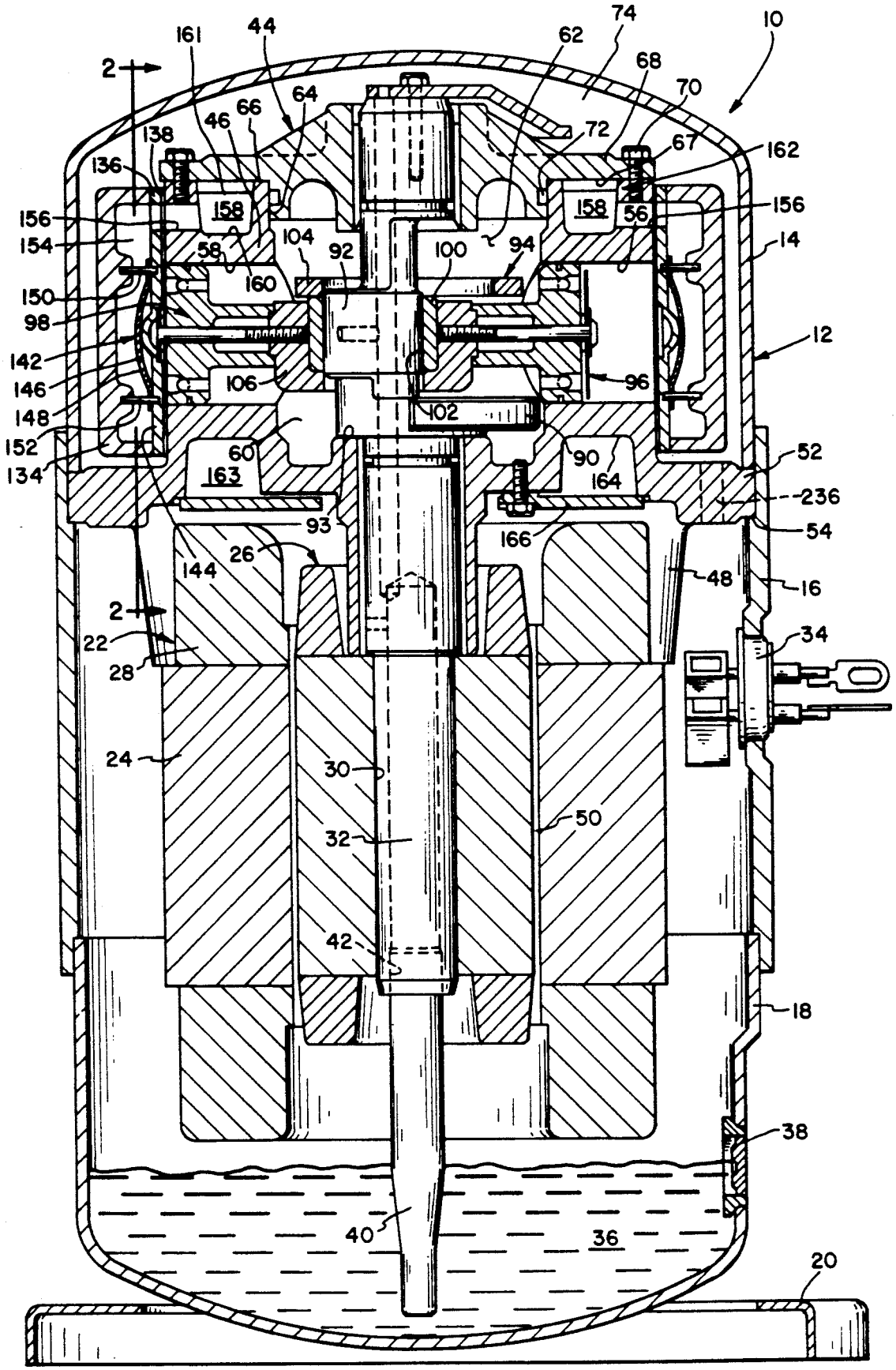
FIG. 1 is a longitudinal sectional view of a compressor incorporating the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position.

Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power.

Compressor assembly 10 also includes an oil sump 36 located in bottom portion 18. Oil glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment shown in FIG. 1, is a scotch yoke compressor mechanism generally designated at 44. A description of a basic scotch yoke compressor design is given in U.S. Pat. 4,838,769 assigned to the assignee of the present invention and expressly incorporated by reference herein.

Compressor mechanism 44 comprises a crankcase or cylinder block 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. The lower portion of crankcase 46 and mounting flange 52 serve to divide the interior of the housing 12 into an upper chamber in which the compressor mechanism 44 is mounted and a lower chamber in which motor 22 is disposed. A passage 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders bores or compression chambers, two of which are shown in FIG. 1 and designated as cylinder bore 56 and cylinder bore 58. Crankcase 46 may be constructed by conventional casting techniques. The four radially disposed cylinder bores open into and communicate with a central suction cavity 60 defined by inside cylindrical wall 62 in crankcase 46. A relatively large pilot hole 64 is provided in a top surface 66 of crankcase 46. Various compressor components, including crankshaft 32, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, and O-ring seal 72 isolates suction cavity 60 from a discharge pressure space 74 defined by the interior of housing 12.

Crankshaft 32 is rotatably journalled in crankcase 46, and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinder bores 56 and 58, respectively.

Scotch yoke mechanism 94 comprises a slide block 100 including a cylindrical bore 102 in which eccentric portion 92 is journalled. Scotch yoke mechanism 94 also includes a pair of yoke members 104 and 106 which cooperate with slide block 100 to convert orbiting motion of eccentric portion 92 to reciprocating movement of the four radially disposed piston assemblies.

Compressed refrigerant within each cylinder bore 58 is discharged through valve plate 136. With reference to cylinder 58 in FIG. 1, a cylinder head 134 is mounted to crankcase 46 with valve plate 136 interposed therebetween. Valve plate gasket 138 is provided between valve plate 136 and crankcase 46.

Discharge valve assembly 142 is situated on a top surface 144 of valve plate 136. Generally, compressed gas is discharged through valve plate 136, past a discharge valve 146 that is limited in its travel by discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be lifted away from top surface 144 along guide pins 150 and 152.

Figure 2:
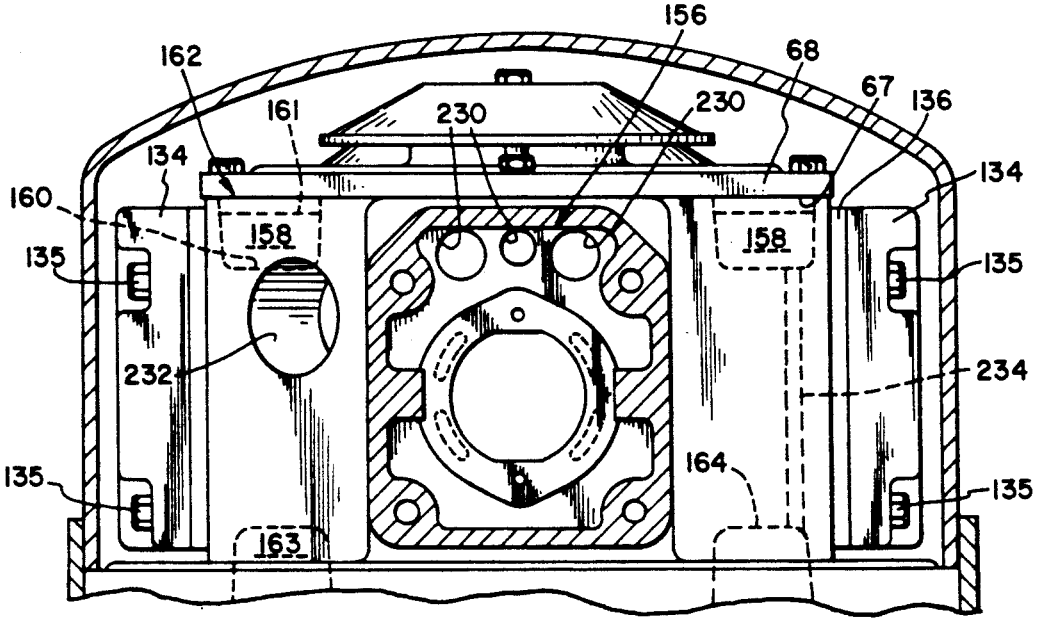
FIG. 2 is a sectional view of the compressor of FIG. 1 taken along line 2—2 in FIG. 1 and viewed in the direction of the arrows.

Referring once again to cylinder head 134, a discharge chamber 154 is defined by the space between top surface 144 above plate 136 and the underside of cylinder head 134. Head 134 is mounted about its perimeter to crankcase 46 by a plurality of bolts 135, as shown in FIG. 2. Discharge gas within discharge chamber 154, associated with each respective cylinder, passes through a respective connecting passage 156 in crankcase 46. Connecting passage 156 provides communication from discharge space 154 to a top annular muffling chamber 158. Top muffling chamber 158, common to and in communication with all of the compression chambers 154, is defined by an annular channel 160 formed in top surface 66 of crankcase 46 and a top plate or cover portion 67 of case bearing 68. Connecting passage 156 passes not only through crankcase 46, but also through holes in valve plate 136 and valve plate gasket 138.

The internal baffling system of the present invention is located within top muffling chamber 158, as shown in FIG. 2. The baffle arrangement of the present invention includes baffles 159, preferably formed by web members on crankcase 46, that divide top muffling chamber 158 into a plurality of sub-chambers 170. Baffles 159 partially separate the discharge valve assemblies 142 from each another. Each baffle 159 includes a top wall 161 that is spaced away from top plate portion 67 (FIG. 2) to permit refrigerant to flow between sub-chambers 170. Top wall 161 is spaced away from top plate or cover portion 67 to create a restricted opening or clearance passage 162.

Since top wall 161 is spaced away from the top plate portion 67, baffle 159 creates a restricted opening 162 in which compressor cross talk or pressure pulses are throttled and reduced. Additionally, pressure pulses traveling out of passage 156 impact baffle 159 and are reduced in magnitude.

The size of clearance passage 162 may vary depending on the particular compressor design and muffler size. The particular size of clearance passage is one in which the crosstalk is throttled and reduced, but the pressure drop through the muffler system is minimized. One size range of said passage 162 found to operate is approximately 0.260 inches to 0.290 inches. This size range will of course change depending on the particular design and construction of the compressor.

Figure 3:
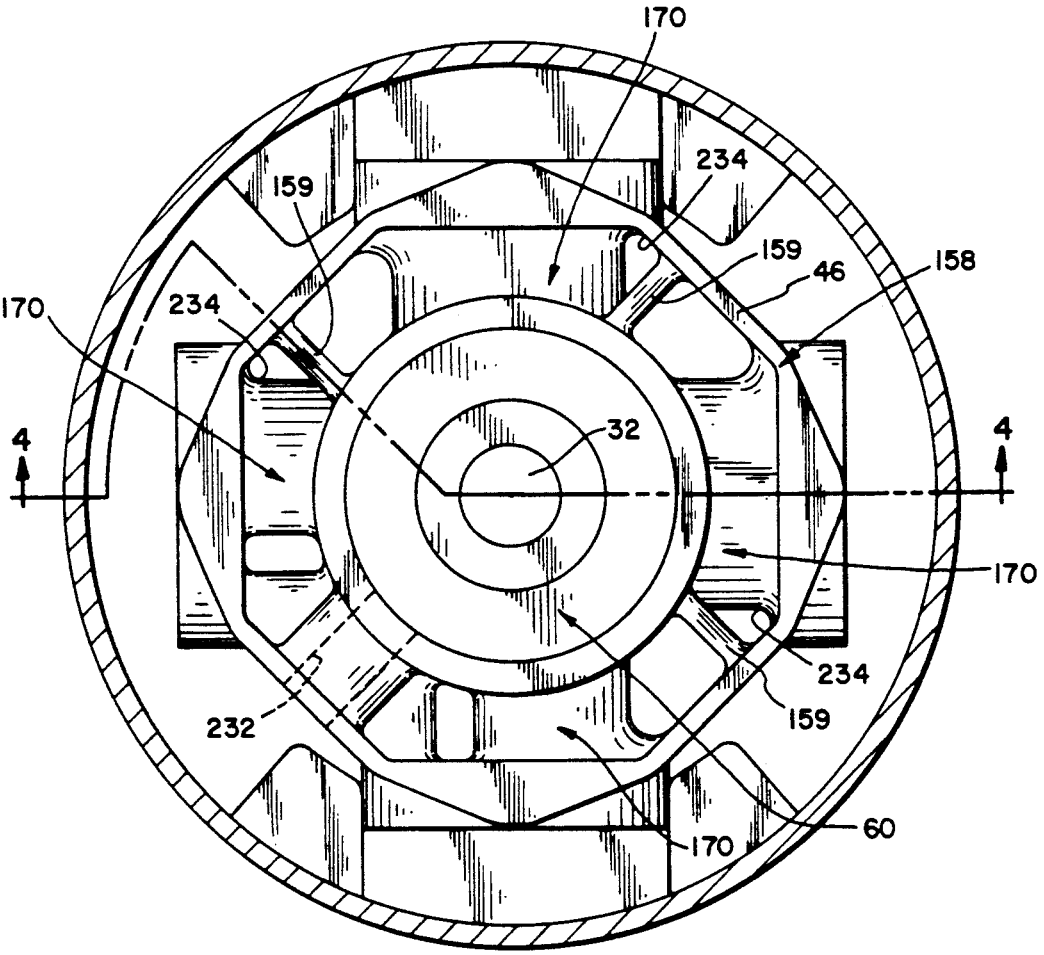
FIG. 3 is a top view of the crankcase.
Figure 4:
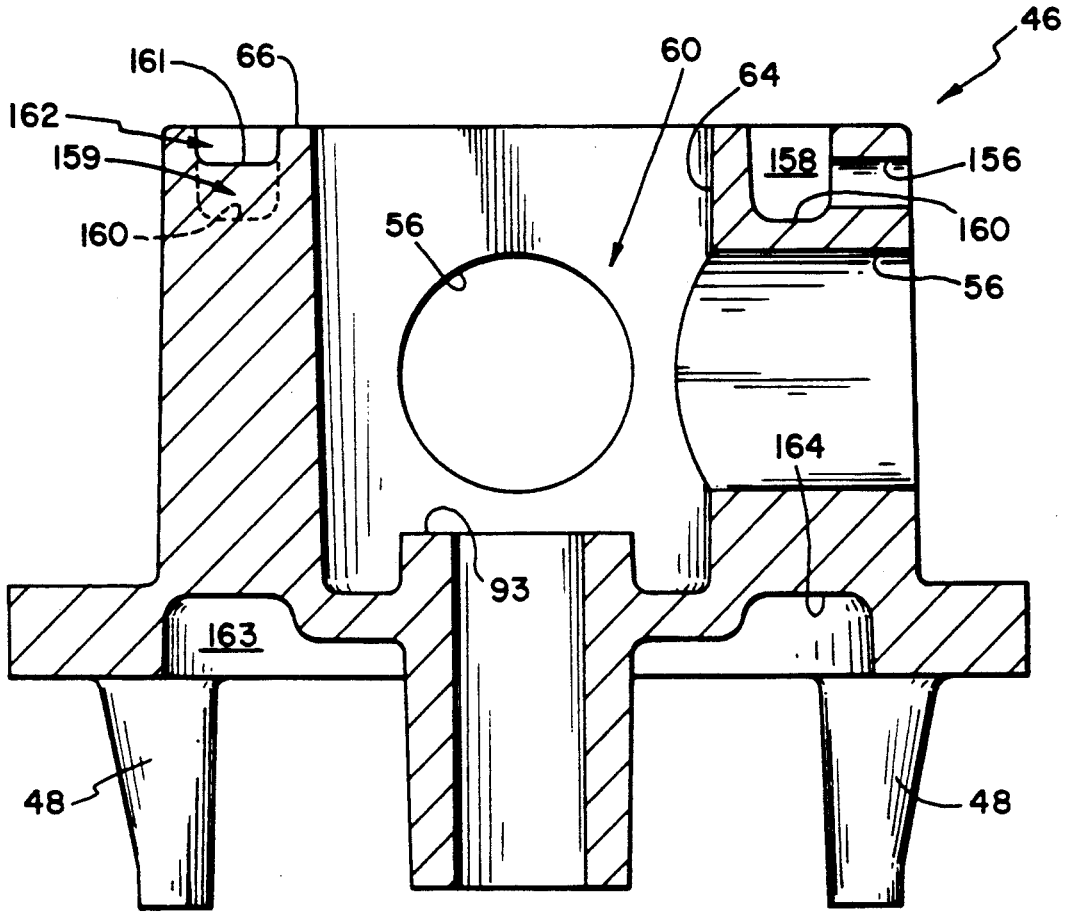
FIG. 4 is a sectional view of the crankcase of FIG. 3 taken along line 4—4 in FIG. 3 and viewed in the direction of the arrows.

Top muffling chamber 158 communicates with bottom muffling chamber 163 and subsequently into housing 12 by means of exit passageways or ports 234 extending through crankcase 46 (FIGS. 2 and 3). Bottom muffling chamber 163 is defined by an annular channel 164 and a muffler cover plate 166 (FIG. 1). Cover plate 166 is mounted against bottom surface 76 of crankcase 46 at a plurality of circumferentially spaced locations by bolts 168 in threaded holes 169. Compressed gas within bottom muffling chamber 163 exits past cover plate 166 in housing 12.

FIG. 2 shows connecting passage 163 of FIG. 1 as comprising a plurality of holes 230 through crankcase 46, associated with each radially disposed cylinder arrangement, to connect between discharge chamber 154 and top muffling chamber 158. A suction inlet opening 232 is included in crankcase 46, providing communication between a suction inlet tube (not shown) and suction cavity 60 defined within crankcase 46.

For discussion purposes, only the operation of piston assembly 98 will be described. Other piston assemblies within compressor 10 operate in a similar manner.

In operation, piston assembly 98 will reciprocate within cylinder bore 58. As piston assembly 96 moves from bottom dead center position to top dead center position on its compression stroke, gaseous refrigerant within cylinder bore 58 will be compressed and forced through the discharge port in valve plate 136, past discharge valve 142, through discharge chamber 154, connecting passage 156, and into common discharge chamber 158.

As this pulse of compressed refrigerant gas travels through top common muffler chamber 158 having sub-chambers 170, it will be restricted through openings 162 and will reduce the impact baffles 159. This reduces the pressure pulse communicated to other discharge valves 146 back through connecting passage 156 and discharge space 154. At this point, the discharge gas may travel over top wall 161 of baffle 159 to communicate with other discharge refrigerant streams from the other discharge valves 146. Reduction of the pressure pulses impacting discharge valve assemblies 142 increases the opening speed of their associated discharge valves 146. Faster and easier opening discharge valves permit more efficient compressor operation.

The compressed refrigerant now travels through exit port or passageways 234 into lower muffling chamber 162 and then on into the compressor housing 12.

It will be appreciated that alternatively, baffles 159 may be formed on top plate portion 67, thereby forming openings 162 on the bottom of annular channel 160. It is also evident that the baffle system described here is applicable to other types of compressors other than scotch yoke compressors. The baffle system may be utilized in double reciprocating piston compressors having common discharge chambers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic compressor comprising:

a hermetically sealed housing;

a motor-compressor unit disposed within said housing, said unit including a cylinder block defining a plurality of cylinder bores, said unit having a plurality of pistons reciprocatable within said cylinder bores, each bore including an associated discharge valve, said unit including a cylinder head attached over each bore;

a common muffler chamber within said housing in communication with said discharge valves, into which said discharge valves empty, said muffler chamber including an exit port; and a baffle arrangement separating said common muffler chamber into a plurality of sub-chambers, each sub-chamber in communication through a cylinder head with a respective said discharge valve, each said discharge valve emptying directly into a separate sub-chamber, said baffle arrangement permitting fluid communication between said sub-chambers at other locations than at said exit port, said baffle arrangement preventing undeflected pressure pulses to travel from one discharge valve to any other discharge valve, whereby said baffle arrangement reduces the pressure pulses between said discharge valves and discharge valve performance is enhanced.

2. The hermetic compressor of claim 1 in which said baffle arrangement is formed by a plurality of web members on said cylinder block dividing said common muffler chamber into sub-chambers.

3. The hermetic compressor of claim 1 in which said baffle arrangement forms a clearance passage within said common muffler chamber, said clearance passage having a width of approximately 0.260 to 0.290 inches.

4. The hermetic compressor of claim 1 in which said baffle arrangement forms a clearance passage within said common muffler chamber, said clearance passage having a width that minimizes pressure pulses between said discharge valves.

5. A hermetic compressor comprising:

a hermetically sealed housing;

motor compressor unit having a crankcase, a plurality of cylinder bores in said crankcase, a plurality of pistons disposed within respective said cylinder bores, and a scotch yoke means connected to a vertical crankshaft disposed in said crankcase and driven by said motor for reciprocating said pistons and compressing refrigerant gas in said cylinder bores, a cylinder had attached to said crankcase over each said cylinder bore;

a discharge means for reducing discharge pressure pulses, said discharge means connected to said crankcase and in communication with said cylinder bores, said discharge means having a plurality of baffled sub-chambers, each said cylinder head emptying into a separate sub-chamber, said discharge means having at least one exit port communicating to said housing, said baffled chambers in communication together not at said exit port, whereby discharge pressure spikes between said cylinder bores are reduced and undeflected pressure pulses between discharge valves are prevented thereby increasing discharge valve performance.

6. The hermetic compressor of claim 5 in which said cylinder bores empty compressed fluid into a common muffler chamber.

7. The hermetic compressor of claim 6 in which said sub-chambers are formed from a plurality of web members disposed in said common muffler chamber.

8. The hermetic compressor of claim 7 in which a top plate cover attaches over said common muffler chamber.

9. The hermetic compressor of claim 7 in which said web members create at least one clearance passage with said top plate cover, said clearance passage having a width of approximately 0.260 to 0.290 inches.

10. The hermetic compressor of claim 5 in which said baffle arrangement forms a clearance passage within said common muffler chamber, said clearance passage having a width that minimizes pressure pulses between said discharge valves, while minimizing the pressure drop through said discharge means.

11. A hermetic compressor comprising:

a hermetically sealed housing;

a vertically oriented scotch yoke motor-compressor unit in said housing comprising a compressor mechanism being drivingly connected to a motor;

said compressor mechanism including a common muffler chamber, a plurality of discharge valve assemblies that empty compressed gas into said common muffler chamber, and a top cover portion attached over said compressor mechanism;

a top cover plate attached to said compressor mechanism;

said common muffler chamber formed between said crankcase and said top cover portion, said common muffler chamber including a discharge port communicating to the interior of said housing, said common muffler chamber communicating with said discharge valve assemblies, said common muffler chamber having a plurality of web portions dividing said common muffler chamber into a plurality of sub-chambers connected by restricted passageways, each said discharge valve assembly emptying into a separate sub-chamber, said web portions preventing undeflected pressure pulses between discharge valves, whereby discharge cross talk and back pressure spikes between said discharge valves are reduced to increase discharge valve performance.

12. The hermetic compressor of claim 11 in which said baffle arrangement forms a clearance passage within said common muffler chamber, said clearance passage having a width that minimizes pressure pulses between said discharge valves.

13. The hermetic compressor of claim 11 in which said web portions create said passageways having a width of approximately 0.260 inches between said webs and said muffler chamber.

14. The hermetic compressor of claim 11 in which said muffler chamber is annular having at least four sub-chambers.

15. The hermetic compressor of claim 11 having at least two discharge ports communicating between said sub-chambers and said housing.

* * * * *